US005974824A

United States Patent [19]

Galockin et al.

[11] Patent Number: 5,974,824

[45] Date of Patent: Nov. 2, 1999

[54] CONTAINER COOLING JACKET AND PRE-CHILL DISPENSING SYSTEM THEREFOR

[75] Inventors: Longin Galockin, Deerfield, Ill.; B. Douglass Montgomery, Surrey, Canada

[73] Assignee: Cold Tap Marketing, Inc., Irving, Calif.

[21] Appl. No.: 08/857,615

[22] Filed: May 16, 1997

[51] Int. Cl.[6] ..... B67D 5/62; F25D 17/02

[52] U.S. Cl. ..... 62/394; 62/434; 222/146.6

[58] Field of Search ..... 62/394, 389, 391, 62/371, 372, 515, 516, 518, 430, 434, 439; 222/129.1, 146.6

[56] References Cited

U.S. PATENT DOCUMENTS

| | | | |
|---|---|---|---|
| 2,184,380 | 12/1939 | Deibel | 62/394 |
| 2,625,804 | 1/1953 | Patch et al. | 165/46 |
| 2,646,667 | 7/1953 | Kromer | 62/394 |
| 4,213,498 | 7/1980 | Vandenbossche | 165/136 |
| 4,242,884 | 1/1981 | Kotschwar | 62/371 |
| 4,514,993 | 5/1985 | Johnson | 62/372 |
| 4,653,290 | 3/1987 | Byrne | 62/372 |
| 4,742,939 | 5/1988 | Galockin | 222/68 |
| 4,986,089 | 1/1991 | Raab | 62/457.4 |
| 5,109,588 | 5/1992 | Hewlett et al. | 220/694 |
| 5,277,941 | 1/1994 | Marshall | 428/12 |
| 5,377,495 | 1/1995 | Daigle | 62/125 |
| 5,564,568 | 10/1996 | Rankin, Sr. | 206/446 |

FOREIGN PATENT DOCUMENTS

| | | | |
|---|---|---|---|
| 648103 | 3/1992 | Australia | 165/46 |
| 1117102 | 1/1982 | Canada | 165/46 |
| 190289 | 8/1986 | Japan | 165/46 |
| 454325 | 9/1936 | United Kingdom | 165/46 |

*Primary Examiner*—William Doerrler
*Attorney, Agent, or Firm*—James P. Hanrath

[57] ABSTRACT

A cooling jacket and dispenser system for a container of liquid beverage comprises a flexible sheet of thermally insulating material designed to circumferentially fit around the container to be cooled thereby. The sheet has a cooling line coil disposed in serpentine fashion upon an interior facing surface thereof for direct or indirect contact with the external side periphery of the container to be cooled thereby. The cooling line coil is operatively connected to a cooling bath fluid supplied by and recirculated to a liquid dispenser assembly.

7 Claims, 7 Drawing Sheets

CONTAINER COOLING JACKET AND PRE-CHILL DISPENSING SYSTEM THEREFOR

BACKGROUND OF THE INVENTION

1. Field of the Invention.

The present invention relates generally to a cooling sleeve or jacket for use with containers of liquids, such as a keg of beer, and a pre-chill dispensing system therefor, particularly, a cooling jacket suited for operative connection with a coolant bath chilled by a refrigerant cooling line of a liquid dispenser assembly which pre-chills the container of liquid prior to a dispensing of the liquid thereof by the liquid dispenser assembly.

2. Description of the Related Art.

The dispensing of beer or other beverages from kegs is well known. Keg beer provides an economical method of packaging beer.

It is generally known to cool beer kegs (e.g., ponies, quarter barrels, half barrels, tappers, and the like) by immersing the keg in an open container such as a washtub or cut down drum filled with ice. Such a practice is somewhat inconvenient, messy, and involves considerable effort: and labor before and after use. The ice will often melt significantly prior to the keg being empty, creating water. As the keg is emptied, it becomes lighter and will often float in this water before it is fully emptied. This creates problems in pumping the keg to maintain internal pressure. Additionally, ice, apart from being costly, is often not available at points of beverage consumption.

Attempts have been made to maintain a cooled temperature to the liquid of a keg container.

In U.S. Pat. No. 4,242,884 to Kotschwar there is disclosed a beverage cooler which comprises a segmented foam cooler structure that envelopes a keg and includes a pocket which when filled with a relatively small portion of ice seeks to maintain the keg at a sufficiently cold temperature.

In U.S. Pat. No. 4,514,993 to Johnson there is disclosed an insulated barrel cooler comprising a cylindrical, open-ended, insulated cloth sleeve or jacket that slips over a beer keg or the like to keep the barrel cold. The insulated cloth sleeve has a plurality of vertically stitched seams displaced equal distance around the sleeve which creates internal pockets into which are placed plastic bags of frozen water or the like to cool the barrel.

In U.S. Pat. No. 4,653,290 to Byren, there is disclosed a beer keg ice sleeve comprising a slip-over ice sleeve open at the bottom and top and having inner and outer sleeve members with an ice pocket therebetween for reception of ice cubes, chipped ice or the like. A drain valve is provided at the lower portion of the outer liner.

In U.S. Pat. No. 4,986,089 to Raab, there is disclosed an adjustable refrigeratable beverage wrap around holder which circumferentially encloses the beverage container and includes a plurality of individually disposed freezable masses consecutively positioned along an exterior layer of insulated material. The freezable masses form an inner diameter for receiving the exterior walls of the beverage container. When frozen, the freezable masses will absorb heat from the beverage and container and thus cause the beverage to remain chilled for an extended period of time.

In U.S. Pat. No. 5,277,941 to Marshall, there is disclosed a system to insulate and retain cold temperature comprising a series of layers of materials, namely, a hard durable plastic layer of polyvinyl chloride or similar material, a layer of retardant aluminum, a layer of styrofoam, a layer of neoprene, and a cavity having an input valve at the top of the system wherein liquid dry ice is initially introduced, and upon stabilization the liquid dry ice becomes sold. The system is constructed in the outer shape of a keg to constitute a jacket therefor which would be removable with hinges and buckles to keep kegs cold without refrigeration or ice. When the dry ice converts from a sold to a gas, the gaseous fumes can be released from the system from an escape or purge valve at the bottom of the system.

In U.S. Pat. No. 5,564,568 to Rankin, Sr. there is disclosed an insulating cover for keg beer. The cover consists of a relatively flexible insulating material which substantially surrounds one or more kegs of beer. The insulative properties are sufficient to maintain a relatively constant cold temperature without the use of ice, although multiple-use sealed freeze packs may be placed within a cover for the system.

The container cooling jacket and pre-chill dispensing system therefor of the present invention advantageously pre-chills, maintains, and preserves a cool temperature to the liquid of a container, such as beer of a beer keg, prior to the dispensing of the liquid through a liquid dispenser assembly without resort to ice or cold packs. The container cooling jacket is designed to externally extend, advantageously for either short or long distances, and recirculate a coolant bath fluid chilled by a refrigerant cooling line of the liquid dispenser assembly. The container cooling jacket can be placed around the external periphery of the keg or container to thereby pre-chill, maintain cool, and preserve the liquid therein prior its dispensing through the liquid dispenser assembly. Thus, the liquid of the container is dual-cooled; first by a pre-chill maintenance of the liquid within its container, and second by a cooling of the liquid as it is dispensed through a liquid line of the liquid dispenser assembly. The coolant bath fluid of the liquid dispenser assembly thus circulates in a cooling coil line of the container cooling jacket to cool a container external of the liquid dispenser assembly and the coolant bath fluid is also used to cool the liquid of the container when it is drawn into a liquid line internal of the liquid dispenser assembly for dispensing. This dual cooling capacity gained by use of the container cooling jacket and liquid dispenser assembly allows for an efficient, quick servicing of greater quantities of remote sources of cooled beverages, particularly during peak and high demand times therefor, such as, for example, during catering events or intermissions of a sporting or other social event. The present invention also achieves advantages of portability since the cooling jacket and associated liquid dispenser assembly can operate from an electric or gas or gasoline power source. The present invention also eliminates the need for cold storage rooms for containers or kegs or the transport of the same therefrom. Also, the extensions of the coolant bath fluid cooling line can be of short or long length.

SUMMARY OF THE INVENTION

In accordance with the present invention there is provided a cooling jacket for a container of liquid comprising an at least partially flexible sheet, the sheet forming a jacket and being circumferentially suited to fit around the container in a circumscribing relation, the sheet having a cooling line coil disposed upon an interior facing surface thereof for direct or indirect contact with the external side periphery of the container when placed in such circumscribing relation, the cooling line coil having a first end thereof suited to receive a coolant bath fluid to cool the cooling line coil and having a second end thereof suited to recirculate the coolant bath fluid.

The present invention further provides for a dispensing system comprising a liquid dispenser assembly and a cooling jacket, the liquid dispenser assembly having an inlet line to receive a liquid of a container and establish fluid communication therewith, a chilling tank having a liquid line, a chilling line, a refrigeration system, a coolant bath, a coolant bath storage area, a pump outlet line, a pump inlet line, and a dispenser, the liquid line having a first end thereof communicative with the inlet line to circulate the liquid within the liquid line and a second end thereof communicative with the dispenser to dispense the liquid from the liquid line, at least a portion of the internal area of the chilling tank serving as the coolant bath storage area, the chilling line being in recirculating communication with the refrigeration system and in contact with the coolant bath to allow the chilling line to cool the coolant bath, the coolant bath serving to chill the liquid line, a pump within the coolant bath storage area of the chilling tank to send a portion of the coolant bath to the pump outlet line in communication with the cooling jacket external of the liquid dispenser assembly, the cooling jacket having an at least partially flexible sheet, the sheet forming a jacket and being circumferentially suited to fit around the container in a circumscribing relation, the sheet having a cooling line coil disposed upon an interior facing surface thereof for direct or indirect contact with the external side periphery of the container when placed in such circumscribing relation thereto, the cooling line coil having a first end thereof in operative connection with the pump outlet line to thereby provide access for the coolant bath to cool the cooling line coil and having a second end thereof in operative connection with the pump inlet line capable of recirculating the coolant bath to the coolant bath storage area and pump.

The present invention advantageously provides a dual cooling capacity for a dispensed liquid, first by a pre-chill maintenance of the liquid within its container, and second by a cooling of the liquid as it is dispensed through a liquid line of the liquid dispenser assembly. The dual cooling is effectuated by the coolant bath fluid of the liquid dispenser assembly without resort to ice or cold packs.

Additional features and advantages of the present invention will become apparent to those skilled in the art from the following description and the accompanying figures illustrating preferred embodiments of the invention, the same being the present best mode for carrying out the invention.

DESCRIPTION OF THE PREFERRED EMBODIMENTS

Figure 1:
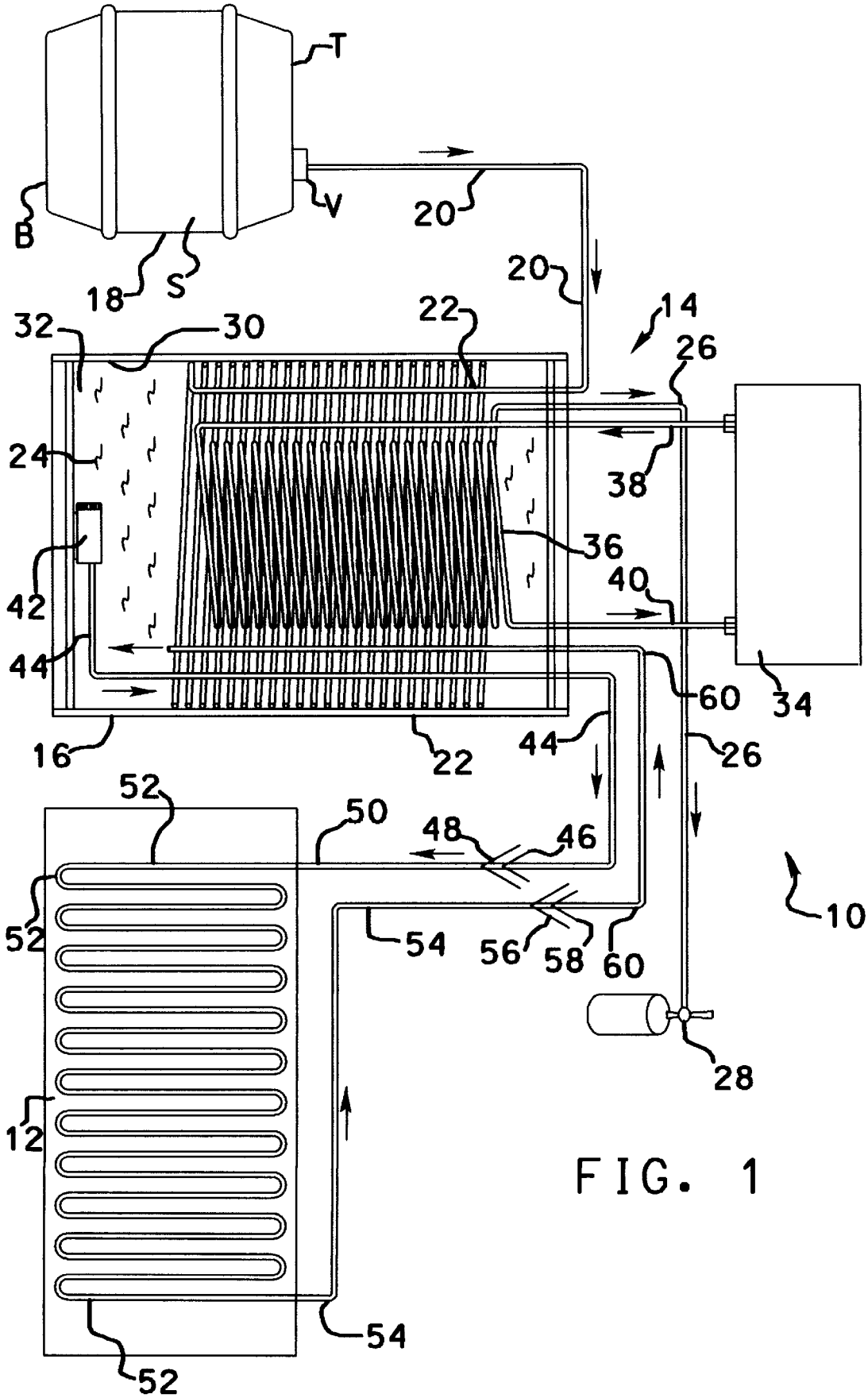
FIG. 1 is a schematic view of a container cooling jacket and pre-chill dispensing system therefor of the present invention.

Referring now to the drawings, there is shown in FIG. 1 a schematic view of a container cooling jacket and pre-chill dispensing system therefor of the present invention. Dispensing system 10 includes a container cooling jacket 12 and a liquid dispenser assembly 14. The container cooling jacket 12 is shown operatively connected with a chilling tank 16. Chilling tank 16 receives a beverage or liquid, such as beer from conventional beer keg 18, via inlet liquid line 20. Inlet liquid line 20 leads into liquid coil line 22 within chilling tank 16 which circulates the beverage or liquid therein such that the same can be chilled by a coolant bath 24 of the chilling tank 16 before the beverage or liquid is outputted from the liquid coil line 22 via outlet beverage connection line 26 to a dispenser 28 or to multiple dispensers (not shown). A substantial portion of the liquid coil line 22 is coiled along the internal annular side periphery 30 of the chilling tank 16 and thus is exposed to the coolant bath fluid 24. A portion of the internal area of said chilling tank serves as a coolant bath storage area 32. The coolant bath fluid is comprised of a glycol, or a glycol based water, or other non-freezing coolant solution readily available in the coolant solution arts.

The chilling tank 16 includes a refrigeration system 34 as is readily available in the refrigerant arts. Refrigeration system 34 includes (but not shown at FIG. 1) a compressor, a condenser, a condenser cooling fan, a dryer, a refrigerant pressure control mechanism, and an evaporator (shown as cooling coil line 36 in FIG. 1) to suitably process an appropriate refrigerant gas to chill the cooling coil line 36 and thus the glycol, or glycol based water, or other non-freezing coolant fluid which comprises the coolant bath 24 of chilling tank 16. The coolant bath 24 in turn chills the liquid coil line 22 and the liquid or beverage circulated therein.

The refrigeration system 34 has an refrigeration inlet line 38 allowing an entering of refrigerant fluid to the cooling coil line 36 of the chilling tank 16 wherein the evaporation of the refrigerant fluid absorbs heat and later allows the compressor to suck warmed refrigerant gas out of refrigeration outlet evaporator line 40 to thereby establish a recirculation for the system. The refrigeration system of the present invention is well know in the refrigeration arts.

Pump 42 at the lower portion of the chilling tank 16 uses the coolant bath 24 to pump export a portion of the same to an external outlet coolant bath line 44 which terminate into male quick connector 46. The male quick connector 46 is suited for proper fluid communicative mating with female quick connector 48 at an inlet external end 50 of the jacket cooling line 52 of container cooling jacket 12. When the male and female quick connectors are joined, the fluid from the coolant bath 24 of the chilling tank 16 is allowed to circulate within the jacket cooling line 52 which extends in serpentine fashion substantially throughout the length of the container cooling jacket 12 until the same exits the outlet external end 54 of the jacket cooling line 52. The outlet external end 54 of jacket cooling line 52 terminates into a second female quick connector 56 suited to mate with a second corresponding male quick connector 58 to establish a return fluid communication of the fluid of the cooling bath 24 within the jacket cooling line 52 back to a return coolant bath line 60 of chilling tank 16 to thereby recirculate the coolant bath to its source, namely the coolant bath storage area 32 and associated pump 42. In this way, the container cooling jacket 12 serves as an external extension of the refrigerating capacity of the chilling tank 16 to thereby provide a dual capacity for chilling liquid ultimately dispensed from the liquid dispenser assembly 14. In this regard, the container cooling jacket 12, when operatively applied in circumscribing fashion about beer keg or liquid container 18, serves to pre-chill the same so that beer or liquid thereof is provided to chilling tank 16 by inlet liquid line 20 and liquid coil line 22 in a pre-chilled condition. The beer or liquid from the keg or container is then further chilled a second time via the liquid coil line 22 chilled by the cold coolant bath 24 of chilling tank 16.

Figure 2:
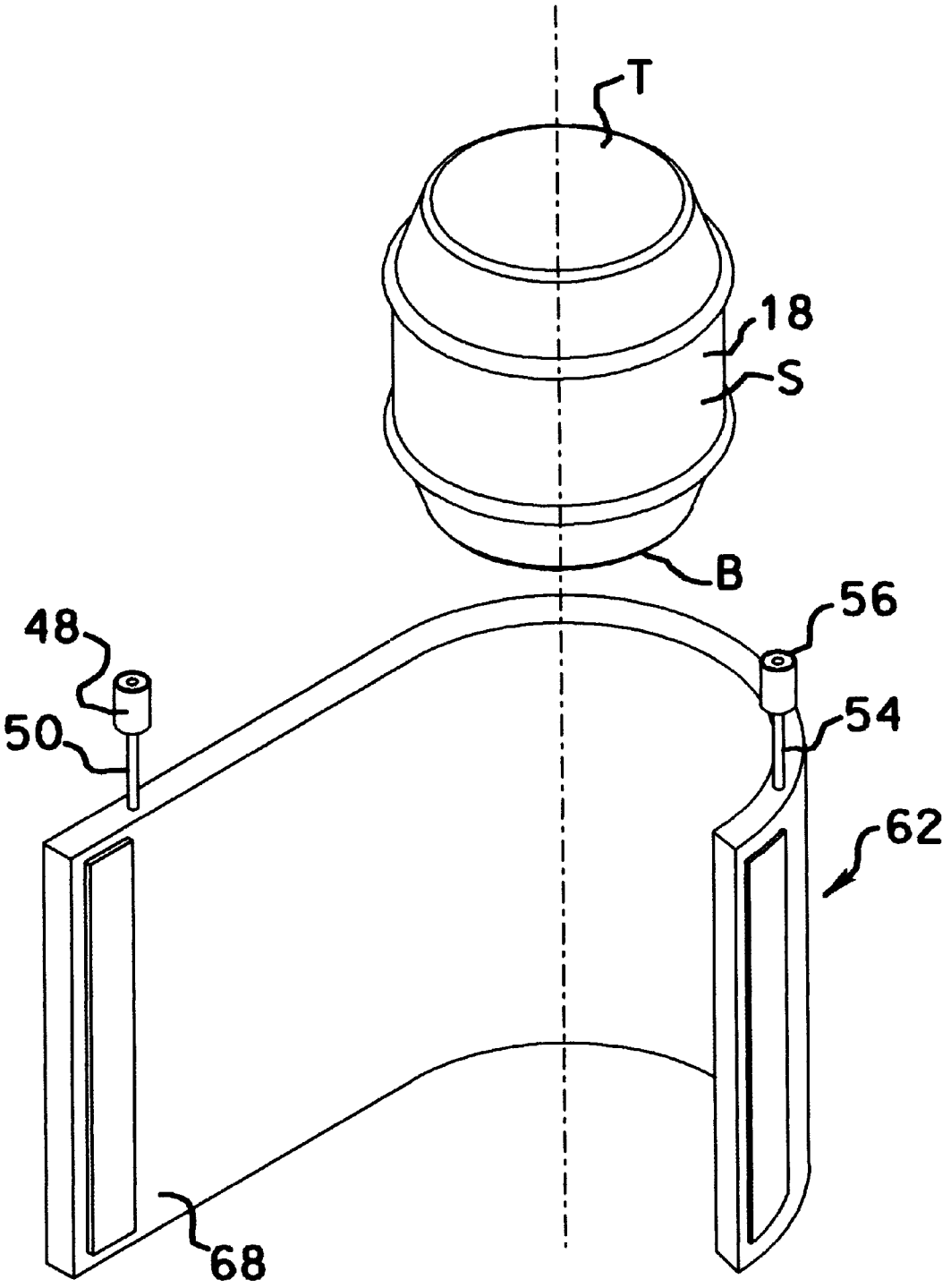
FIG. 2 is a perspective view of the container cooling jacket of the present invention showing the jacket opened and a keg to be cooled thereby exploded therefrom.

Referring now to FIG. 2 there is illustrated a container cooling jacket 62 showing the same in an open position with the conventional beer keg 18 to be cooled thereby exploded therefrom.

As is also illustrated at FIG. 1, conventional beer keg 18 is of quarter barrel or half barrel size for disclosure purposes. Typically, such keg or barrel 18 for beer or other beverage is integrally formed from metal, and has a bulging side walls S and recessed top and bottom end wall T and B joined to the side wall by angular rims or chimes. The sidewall S is usually formed with angular shoulders adjacent to the top and bottom rims or, in some constructions, outwardly formed angular strengthening bands or ribs (not shown) may be formed to define similar angular shoulders. Although not illustrated, it is understood that conventional beer keg 18 has an appropriate tap in the top end wall T to which a hand pump or other mechanism is connected for pressurizing the keg contents. The inlet liquid line 20 illustrated at FIG. 1 serves as, or may be connected to, a dispensing tube for an end valve V of the keg also connected to the tap for which the contents are dispensed.

Figure 3:
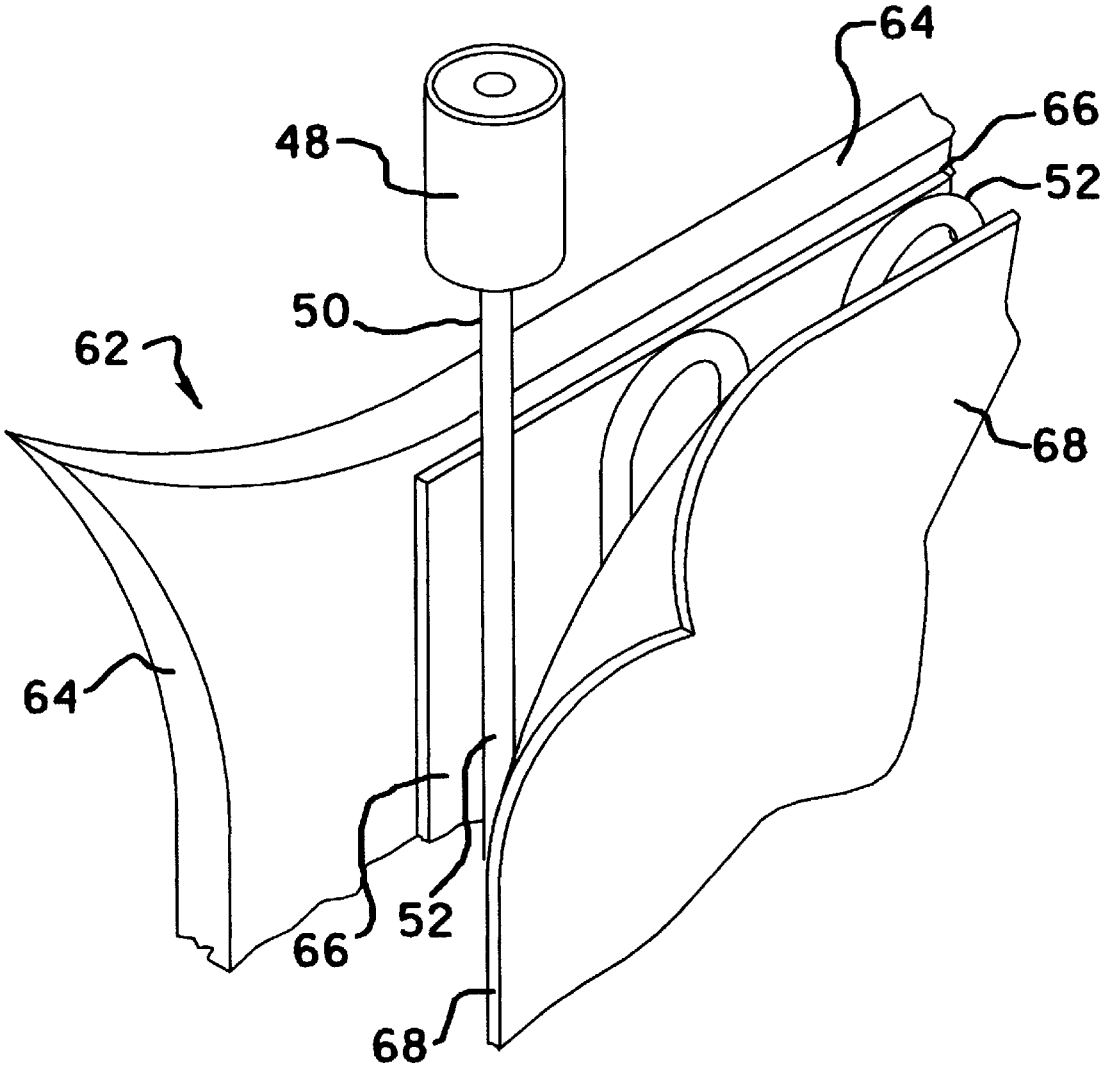
FIG. 3 is a perspective partial view of the container cooling jacket of the present invention with the various layers thereof pealed from each other.
Figure 4:
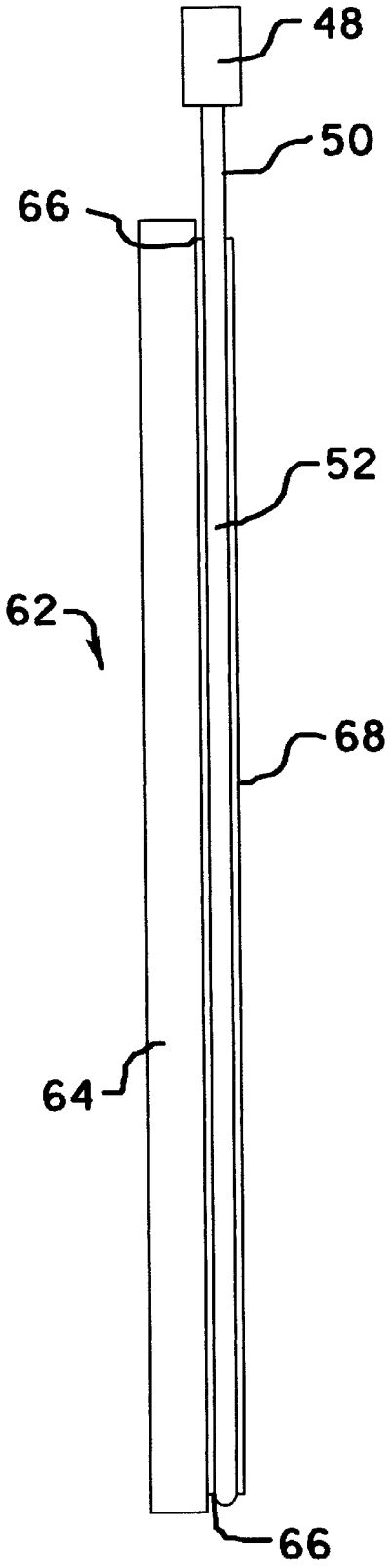
FIG. 4 is a side view of the container cooling jacket of the present invention.
Figure 7:
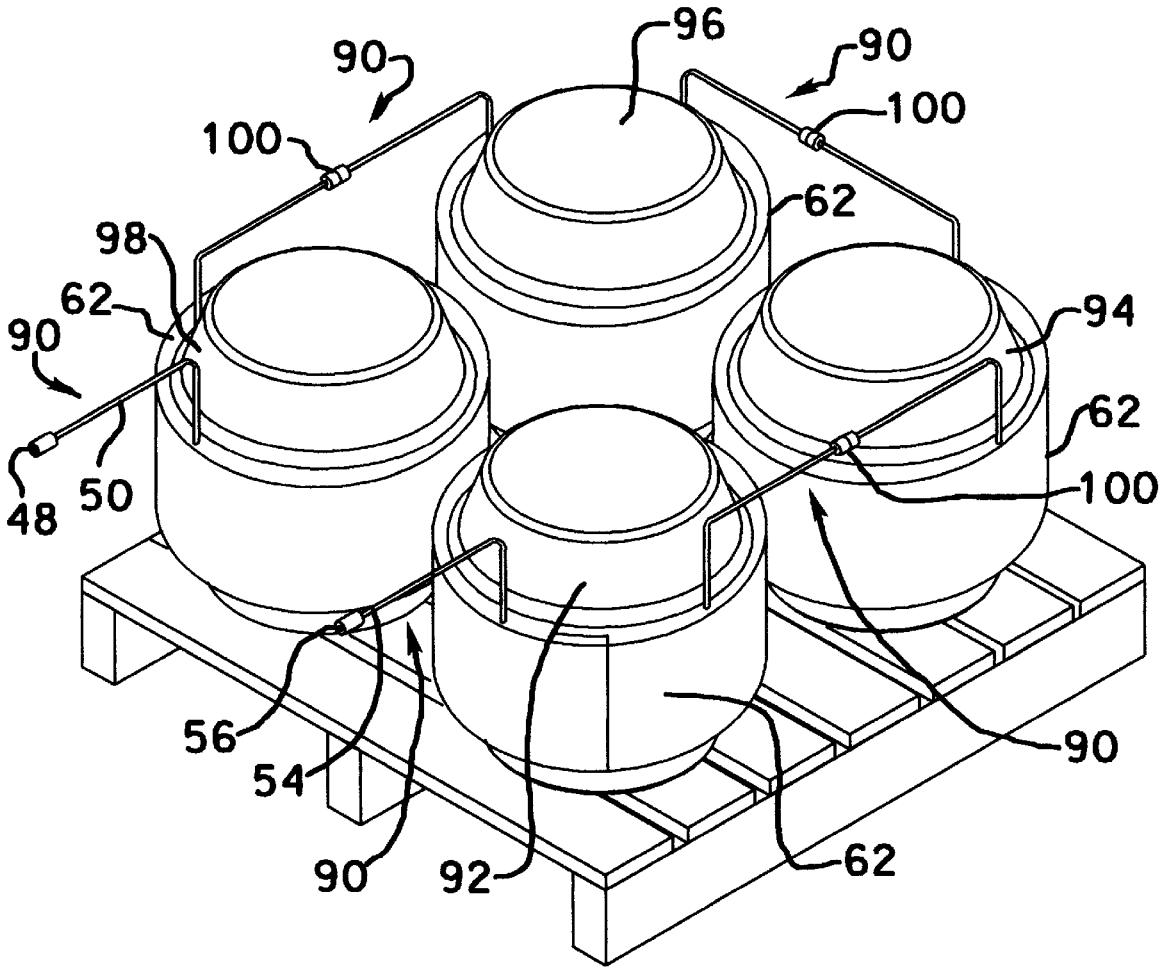
FIG. 7 is a perspective view of the beer keg cooling jacket of the present invention being used in association with a plurality of beer kegs such that the kegs form a serial service line for the dispensing of liquid from the multiple kegs.

As illustrated at FIGS. 3 and 4, the container cooling jacket 62 is comprised of multiple layers. As shown at FIG. 2 and 7, the cooling jacket, when used to enclose a contemporary beer keg or container to be cooled thereby, is designed to be generally cylindrical and compatibly of a slightly larger diameter than the keg or container. The jacket can be made of varying sizes to be capable of fitting more than one size of beer keg or container.

As best illustrated at FIGS. 3 and 4, the cooling jacket preferably has a plurality of layers including an outer layer 64 of a thermally insulative and relatively strong and durable decorative material such as denim, burlap, leno weave polypropylene (scrim) material or the like. Attached to the outer layer 64 is a first interior layer 66 of sheet metal material such as flexible thin aluminum upon which jacket cooling coils 52 are arranged in serpentine fashion to dispose the jacket cooling line along the first interior layer 66 in an arrangement to maximize the area quantity of the jacket cooling line thereon and to promote a wrapping of the sheet-like jacket cooling line around a container. Jacket cooling line 52 is then placed in direct contact with the outer periphery of the container or keg 18 to be enclosed by the container cooling jacket 12 or, alternatively, a second interior layer 68 can be placed upon the jacket cooling line 52, to sandwich the jacket cooling line between the first interior layer 66 and the second interior layer 68 to segregate the line from the outer periphery of the keg 18. If a second interior layer 68 is employed, then the jacket cooling line 52 will indirectly cool the keg 18 through the second interior layer 68 which preferably is a thin and thermally conductive material, such as a sheet metal material including, for example, flexible thin aluminum or alternatively a sheet of cloth material such as sailcloth, parachute, nylon, or the like. In any event, the serpentine placement of jacket cooling line 52, supplemented by the means for fastening means of the container cooling jacket, allows the container cooling jacket to wrap around the keg or container 18 and place jacket cooling line 52 in close proximity to the external periphery of the keg or container to maximizes cooling capacity.

The multiple layers forming container cooling jacket 12 can be assemble or fabricated by any of the methods well known in the layering arts, including by way of example, but not limited thereto, sowing or stitching cloth, glue and adhesives, or various cloth or metal fasteners such as rivets, staples, and the like.

Thus, the cooling jacket serves to both cool and thermally insulate so as to maintain the enclosed keg at a relatively constant cool temperature by placing the jacket cooling line in direct or indirect chilling contact with the external periphery of the keg.

Figure 5:
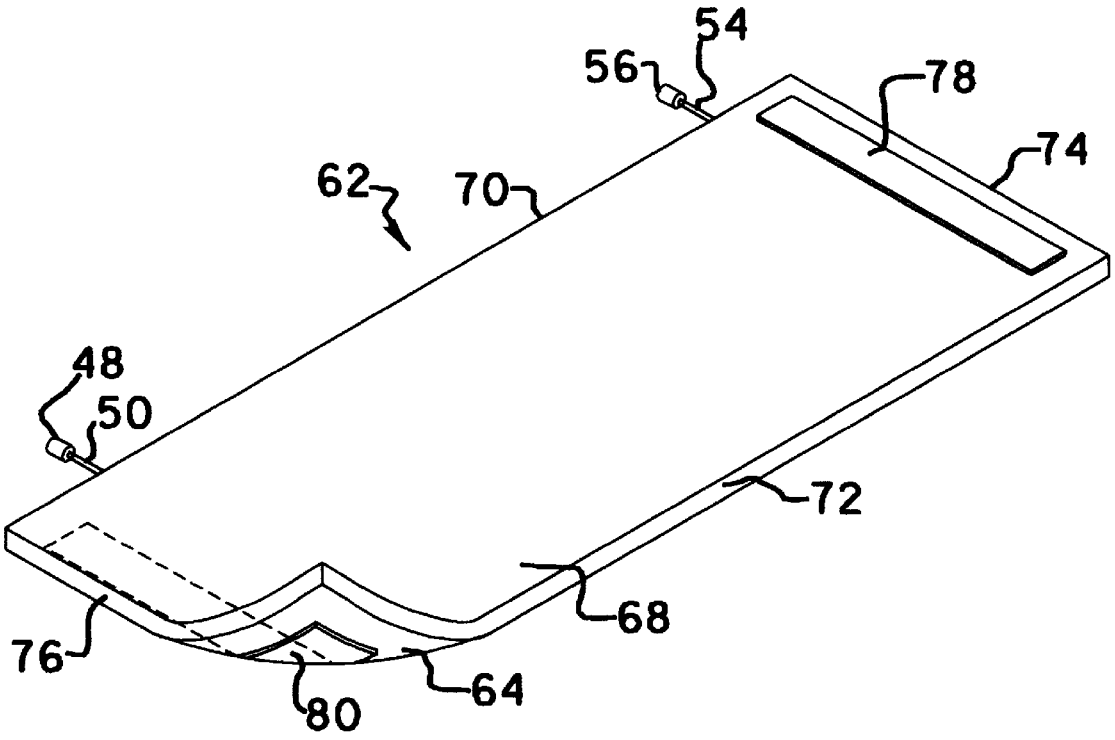
FIG. 5 is a perspective view of the container cooling jacket of the present invention with a hook and pile closure mechanism.
Figure 6:
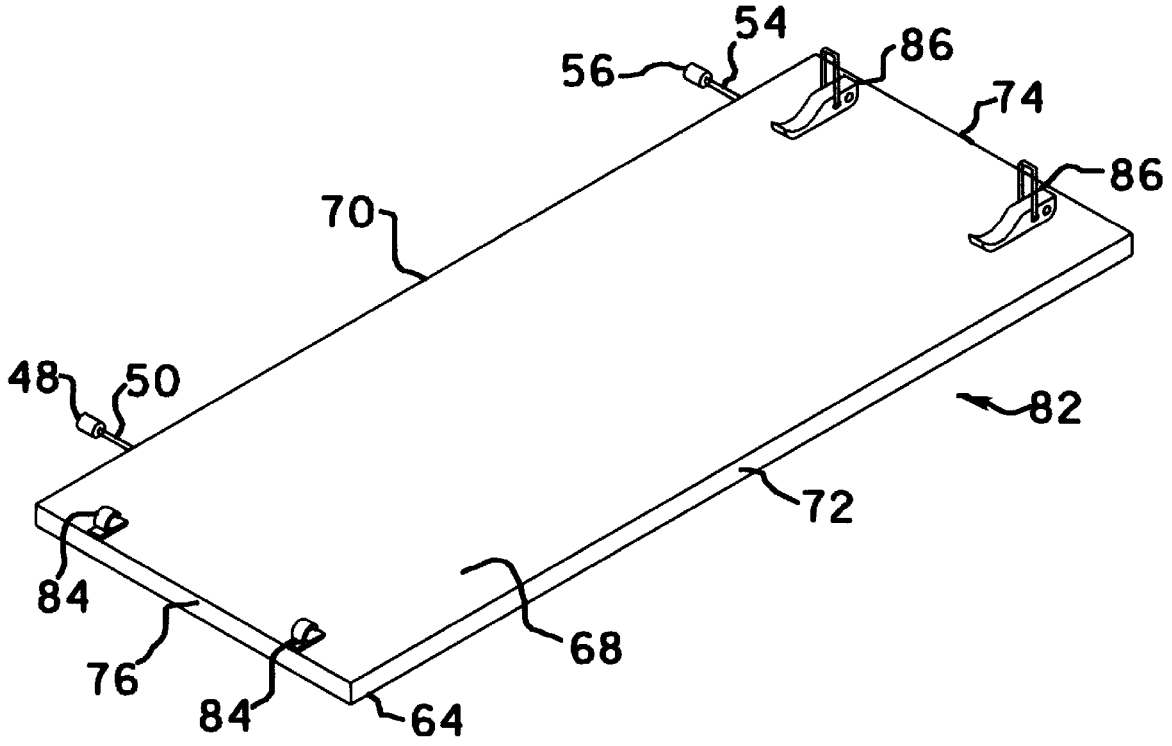
FIG. 6 is a perspective view of the container cooling jacket of the present invention with a latch fastening mechanism.

The container cooling jacket 12 can be provided with means for releasably securing the jacket in a circumscribed space relation to the container or keg to be cooled thereby. For example, as illustrated at FIGS. 5 and 6, the cooling jacket has an open top margin, and open bottom margin, a top side edge 70, a bottom side edge 72, a right longitudinal end 74, and a left longitudinal end 76. When the cooling jacket is wrapped about the circumference of the container to be cooled thereby, the right and left longitudinal ends 74 and 76 are brought into close proximity to each other and can have means to releasably secure the longitudinal ends together. In FIG. 5, right and left longitudinal ends 74 and 76 include have cooperative hook and pile fasteners 78 and 80 respectively, such as Velcro material. Alternatively, as illustrated at FIG. 6, the right and left longitudinal ends 74 and 76 of container cooling jacket 82 may be provided with cooperative latch mechanisms such as hook 84 cooperative with latch 86. The means for releasably securing the jacket in a circumscribed space relation to the container or keg to be cooled thereby illustrated at FIGS. 4 and 5 are exemplary only, and other means such as belts, hole and ties, clamps, and the like may be employed.

As illustrated at FIG. 7, the container cooling jacket 62 of the present invention can be used with a plurality of kegs to fully insulate and cool the multiple kegs in a serial service line 90 for dispensing beverages therefrom. In this regard, kegs 92, 94, 96, and 98 all are equipped with container cooling jackets 62 of the present invention. The appropriate inlet external end 50 and the outlet external end 54 of the jacket cooling line 52 of each of the container cooling jackets 62 are integral with a linear quick connector 100 such that the linear quick connectors can mate and establish fluid communication whereby the kegs are interconnected in a serial line fashion. Thus, multiple kegs can be cooled by a corresponding plurality of container cooling jackets forming a serial service line wherein the serial service line is supplied with the recirculating cooling bath of the chilling tank of the liquid dispenser assembly heretofore described.

From the foregoing description, it will be apparent that the container cooling jacket and pre-chill dispensing system therefor of the present invention has a number of advantages, some of which have been described above and others of which are inherent in the invention. Also, it will be understood that modifications, substitutions, and variations can be made to the container cooling jacket and pre-chill dispensing system therefor or its environment of use described above without departing from the teachings of the present invention. In particular, it is understood that the present invention can be used with not only beer kegs but also other containers for liquids. Further, the configuration of the container cooling jacket and the means for releasably securing the same to a container to be cooled thereby disclosed in the drawings are merely for illustration, and the same can easily be modified to accommodate differing sizes or shapes of beer kegs or other containers and substitute differing securing means. It is, therefore, to be understood that within the scope of the appended claims, the invention may be practiced other than as specifically described therein. Accordingly, the scope of the invention is only to be limited as necessitated by the accompanying claims.

We claim:

1. A dispensing system for pre-chilling a container of liquid comprising a liquid dispenser assembly and a cooling jacket external of said liquid dispenser assembly, said liquid dispenser assembly having an inlet line to receive a liquid of a container and establish fluid communication therewith, a chilling tank having a liquid line, a chilling line, a refrigeration system, a coolant bath, a coolant bath storage area, and a dispenser, said liquid line having a first end thereof communicative with said inlet line to circulate said liquid within said liquid line and a second end thereof communicative with said dispenser to dispense said liquid from said liquid line, at least a portion of the internal area of said chilling tank serving as said coolant bath storage area, said chilling line being in recirculating communication with said refrigeration system and in contact with said coolant bath to allow said chilling line to cool said coolant bath, said coolant bath serving to chill said liquid line, a pump within said coolant bath storage area of said chilling tank to send a portion of said coolant bath to a pump outlet line in communication with a cooling jacket external of said liquid dispenser assembly, said cooling jacket comprising an at least partially flexible sheet, said sheet forming a jacket and being circumferentially suited to fit around said container in a circumscribing relation, said sheet having a cooling line coil disposed upon an interior facing surface thereof for direct or indirect contact with the external side periphery of said container when placed in said circumscribing relation thereto to pre-chill the liquid of said container, said cooling line coil having a first end thereof in operative connection with said pump outlet line to receive said coolant bath to cool said cooling line coil and having a second end thereof in operative connection to a pump inlet line capable of recirculating said coolant bath to said coolant bath storage area and pump.

2. The dispensing system of claim 1, wherein a portion of said liquid line is coiled along the inner periphery of said chilling tank.

3. The dispensing system of claim 1 wherein a portion of said chilling line is coiled in an area within a coiling of said liquid line.

4. The dispensing system of claim 1 wherein said coolant bath is a fluid composition containing a glycol.

5. The dispensing system of claim 1 wherein said cooling line coil of said cooling jacket is disposed in serpentine relation to said interior facing surface of said sheet.

6. The dispensing system of claim 1 further comprising a plurality of said cooling jacket, said plurality of cooling jackets having appropriate first and second end of their cooling line coils interconnected in a serial service line fashion to cool a corresponding plurality of containers of liquid.

7. The dispensing system of claim 1 wherein said cooling line coil serves to chill said container of liquid and said liquid dispenser assembly serves to independently chill the liquid drawn from said container.

* * * * *